US007297071B2

(12) United States Patent
Hyman

(10) Patent No.: US 7,297,071 B2
(45) Date of Patent: Nov. 20, 2007

(54) GOLF CLUB WEDGE

(76) Inventor: Herbert B. Hyman, 535 Via Con Dios, Camarillo, CA (US) 93010

( * ) Notice: Subject to any disclaimer, the term of this patent is extended or adjusted under 35 U.S.C. 154(b) by 23 days.

(21) Appl. No.: 11/149,890

(22) Filed: Jun. 10, 2005

(65) Prior Publication Data

US 2005/0277486 A1 Dec. 15, 2005

Related U.S. Application Data

(60) Provisional application No. 60/579,441, filed on Jun. 14, 2004.

(51) Int. Cl.
*A63B 53/02* (2006.01)
*A63B 53/14* (2006.01)

(52) U.S. Cl. ..... 473/305; 473/314; 473/316; 473/328; 473/350

(58) Field of Classification Search ..... 473/293, 473/328, 340–341, 350, 251, 325, 330–331, 473/313–323, 294, 295, 305–315; D21/746, D21/750

See application file for complete search history.

(56) References Cited

U.S. PATENT DOCUMENTS 2,146,048 A * 2/1939 Barnhart ..... 473/323
2,962,286 A * 11/1960 Brouwer ..... 473/247
D193,098 S * 6/1962 Davis ..... D21/750
D202,504 S * 10/1965 Citro ..... D21/736
3,246,894 A * 4/1966 Salisbury ..... 473/457
3,462,155 A * 8/1969 Pelz ..... 473/238
3,693,978 A * 9/1972 East ..... 473/314
3,719,359 A * 3/1973 Evans et al. ..... 473/328
3,862,759 A * 1/1975 Evans et al. ..... 473/328
3,954,265 A * 5/1976 Taylor ..... 473/252
3,967,826 A * 7/1976 Judice ..... 473/313
4,227,694 A * 10/1980 Drake ..... 473/255
4,260,157 A * 4/1981 Jones et al. ..... 473/165
4,529,202 A * 7/1985 Jacobson ..... 473/256
4,871,174 A * 10/1989 Kobayashi ..... 473/252
5,211,401 A * 5/1993 Hainey ..... 473/340
5,267,733 A * 12/1993 Szokola ..... 473/313
5,294,122 A * 3/1994 Longo ..... 473/328
5,322,285 A * 6/1994 Turner ..... 473/313
5,465,959 A * 11/1995 Cheng ..... 473/312
5,616,087 A * 4/1997 Bothwell ..... 473/316
5,624,329 A * 4/1997 Schneebeli ..... 473/287
5,688,187 A 11/1997 Duncan
5,720,672 A * 2/1998 Smith ..... 473/314
5,795,246 A * 8/1998 Hale ..... 473/340
5,855,524 A * 1/1999 Jenkins ..... 473/294
5,931,741 A 8/1999 Fenton, Jr.
6,033,320 A * 3/2000 Bamberger ..... 473/314
6,152,832 A * 11/2000 Chandler, III ..... 473/293
6,168,536 B1 * 1/2001 Lovett ..... 473/314

(Continued)

*Primary Examiner*—Sebestiano Passaniti
(74) *Attorney, Agent, or Firm*—SoCal IP Law Group LLP; Steven C. Sereboff; John E. Gunther

(57) ABSTRACT

A golf club may have a head that is symmetric about a mid plane. The head may include a generally planar face and a sole, with the face inclined at an angle of at least 10 degrees with respect to the plane of the sole. A shaft having a first bend and a second bend may be inserted into a hosel opening disposed on the head behind the plane of the face.

12 Claims, 5 Drawing Sheets

U.S. PATENT DOCUMENTS

| | | | | |
|---|---|---|---|---|
| 6,190,266 | B1 * | 2/2001 | Pamias | 473/294 |
| 6,224,497 | B1 * | 5/2001 | Antonious | 473/330 |
| 6,241,624 | B1 * | 6/2001 | Zabytko et al. | 473/340 |
| 6,257,994 | B1 * | 7/2001 | Antonious | 473/331 |
| 6,342,018 | B1 * | 1/2002 | Mason | 473/252 |
| 6,447,405 | B1 * | 9/2002 | Chen | 473/328 |
| 6,464,598 | B1 * | 10/2002 | Miller | 473/314 |
| 6,780,118 | B1 * | 8/2004 | McCartney | 473/219 |
| 6,846,246 | B2 * | 1/2005 | Asplund et al. | 473/327 |
| RE38,717 | E * | 3/2005 | Bothwell | 473/316 |
| 7,048,643 | B2 * | 5/2006 | Welsh et al. | 473/293 |
| 2002/0072431 | A1 * | 6/2002 | Studdert | 473/316 |
| 2002/0183132 | A1 * | 12/2002 | Said et al. | 473/314 |
| 2003/0050130 | A1 * | 3/2003 | Wade | 473/287 |
| 2005/0215348 | A1 * | 9/2005 | Baek | 473/314 |

* cited by examiner

GOLF CLUB WEDGE

REFERENCE TO RELATED APPLICATION

This is a non-provisional application from provisional application Ser. No. 60/579,441, filed Jun. 14, 2004, with claims of priority therefrom.

BACKGROUND OF THE INVENTION

1. Field of the Invention

The present invention generally relates to golf clubs, and, more particularly, to clubs which may be used for a multiplicity of functions.

2. Description of the Related Art

Current regulations call for a maximum of 14 golf clubs to be used by a golfer during a round of golf. Typically, a set of golf clubs ranges from a putter through clubs designed for various distances and degrees of loft to woods, which are used for the longest distance shots. The putter, of course, is used for the final shots taken on or around a putting green.

The putter, in particular, is fabricated in numerous different configurations designed by different experts and often carrying a famous golfer's name. The various designs are intended to improve accuracy, enable better control of distance and angle, and in general to enable the golfer to perform better on the green or in the near vicinity of the green. These designs also include different configurations of club shafts and head angles ranging from straight shafts mounted generally perpendicular to the club head to some shafts which are rather extreme in their appearance. Either the hosel or the shaft may go through a plurality of angles or bends between the club head and the grip end of the shaft.

Numerous studies have shown that the majority of the strokes in golf occur within 100 yards of the hole. Many of these are from the fringe or the rough area adjacent the green. Thus the design of clubs used for putting or for approach shots is critical in keeping the golfers' scores within a reasonable range.

In the past, very little attention has been directed toward the solution of the problem of designing a putting head which is particularly useful in the fringe or the longer grass area usually surrounding the putting surface of the green in addition to conventional putter function. One attempt at such a solution is disclosed in U.S. Pat. No. 4,529,202 of Jacobson in which a putter is designed with an elevated putting face raised from the putting surface, and supported between a pair of circular or semi-circular disks. While such a design may have some efficacy in avoiding problems with the height of fringe area grass, it has the disadvantage that the disk members fail to provide a suitable contact surface with the green or fringe requiring an exact angular position of the club head during the putting stroke. This makes it difficult for the average golfer to use the club effectively.

U.S. Pat. No. 5,294,122 of Longo has a head designed to function effectively, both on the green and on the fringe as well as in the higher grass areas surrounding a green, which comprises a rectangular body with a flat base. The putter head is provided with a flat planar base having spaced parallel longitudinal grooves extending in the direction of movement of the putter head in play. The purpose of these grooves is to serve to part the grass blades to facilitate movement of the putter head through the taller grass of the fringe or adjacent rough. The putter head is also provided with a pick-up receptacle for the ball at its rear edge. None of these features are present in the club of the present invention.

So called chipper clubs have been developed for hitting the ball onto the green from close range. The use of these clubs is limited and difficult. Thus, they have not become widely accepted for use by golfers of all abilities.

U.S. Pat. No. 6,033,320 of Bamberger discloses a golf club having a head with a multi-angled hosel (generally S-shaped in the plane of the club face). While the club is said to be usable with a putting stroke from a variety of positions on the golf course, the shape of the golf club, particularly the head, is substantially different from that of the present invention.

A number of putter designs contain a flat, planar face for driving the ball on the green without loft or misalignment. Examples of these may be found in U.S. Pat. No. 5,211,401 of Hainey, U.S. Pat. No. 5,322,285 of Turner and U.S. Pat. No. 6,241,624 B1 of Zabytko et al. The Zabytko et al. device provides for the addition of lead or alloy weights to optimize weight and balance. The present invention comprises a club head of a substantially different shape to achieve its objective.

U.S. Pat. No. 5,624,329 of Schneebeli discloses a matched pair of golf clubs which have identical heads with identical shafts and grips except that one head has a striking face with the loft of a putter and the other head has a second striking face with the loft of a chipper. This pair of golf clubs differs from applicant's dual purpose, multi-function implement of a single club.

Publication No. US2002/0183132 A1 of Said et al. discloses a golf club with a sharp edge at the intersection of the heel surface of the club head and the front face of the club head. This allows the club to be easily swung through obstacles such as those usually encountered in the area of the rough surrounding the green. Except for the sharp edge at the leading surface of the club head, the head appears to be of conventional shape and construction.

U.S. Pat. No. 6,168,536 B1 of Lovett discloses a club with a striking surface having an arcuate leading edge extending downwardly from the heel to a forward-most point of the striking surface. The leading edge is also significantly forward of the center line of the hosel. The golf club head of Lovett is a club wedge rather than a dual purpose club of the present invention.

The golf club disclosed in U.S. Pat. No. 6,342,018 B1 of Mason is designed for a specific purpose, effecting chip shots within 60 yards of the green. The club is fitted with a long shaft which forces the golfer into an upright position to create a chipping stroke similar to a normal putting stroke. The club is generally convex in shape when viewed from the side. The club of this patent is designed for chip shots onto a green up to distances of about 60 yards. The shape of the head of the present invention is notably different from that of Mason.

SUMMARY OF THE INVENTION

In brief, particular arrangements in accordance with the present invention enable a golfer using the club of the invention to utilize a putting stroke to a lofted club head having a loft in excess of 10°. By providing a lie angle of 70° or more, the golfer is required to produce a pendulum stroke. The club is designed to extract a golf ball from the rough around the putting green and the green side bunkers.

One particular arrangement in accordance with the invention incorporates a club with a face having a plurality of transverse grooves to impart spin to the ball and a shaft length of 35 inches to improve control. A degree of radius from heel to toe and a desired radius "bounce" from face to heel serve to prevent stubbing the club into the ground. A symmetrical design incorporates a series of crescent-shaped ridges to provide aiming lines. The design of the club permits the center of gravity to be placed low and behind the hitting surface.

The difficulty in using a full swing near the putting surface has now been simplified to a short pendulum stroke. The ease of use and aiming results in increased confidence and lessened nerve strain on the part of the golfer with generally heightened playing efficiency and pleasure in the game.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
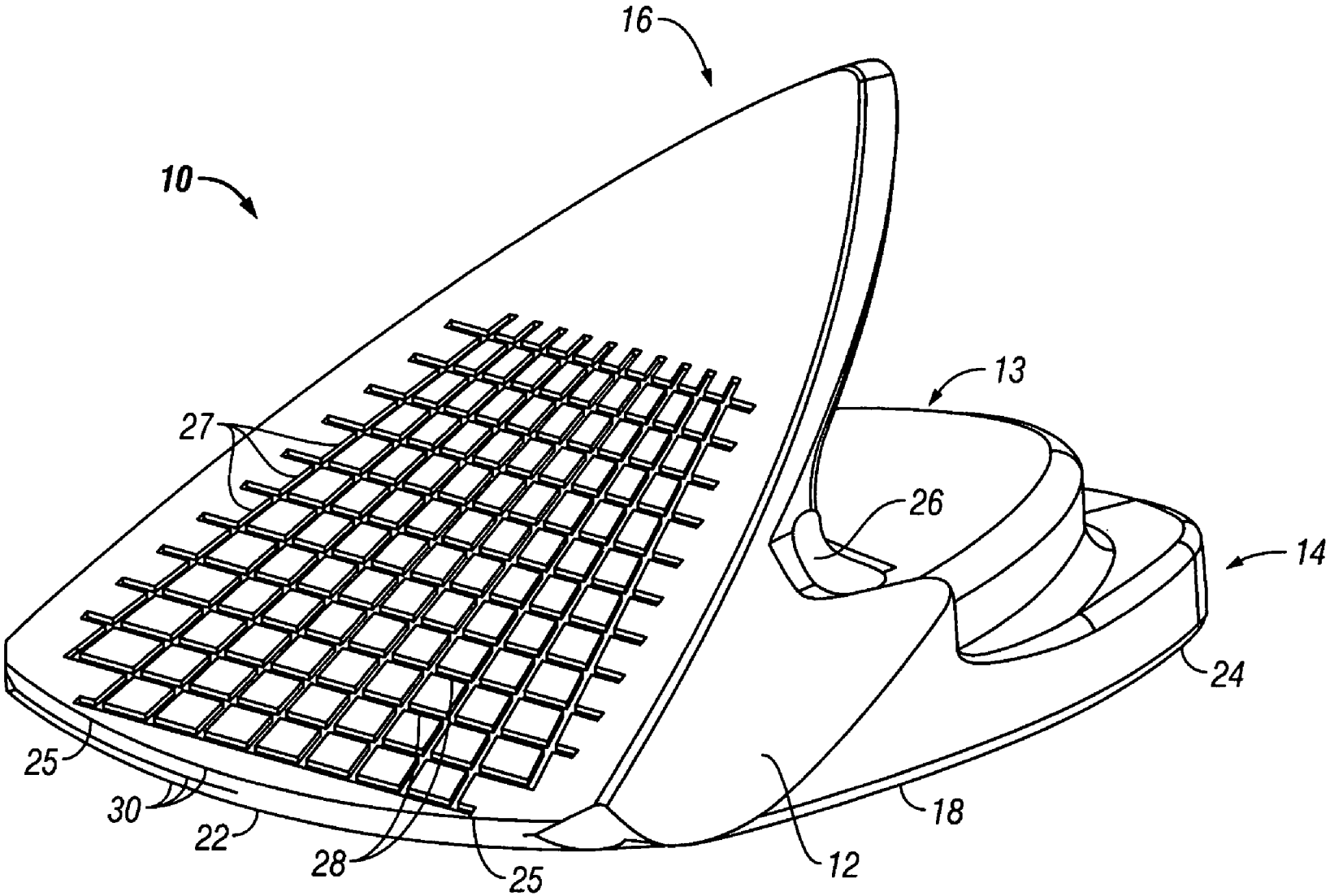
FIG. 1 is a schematic perspective view of one particular arrangement of the club head of the invention as viewed from the forward left side of the head.
Figure 2:
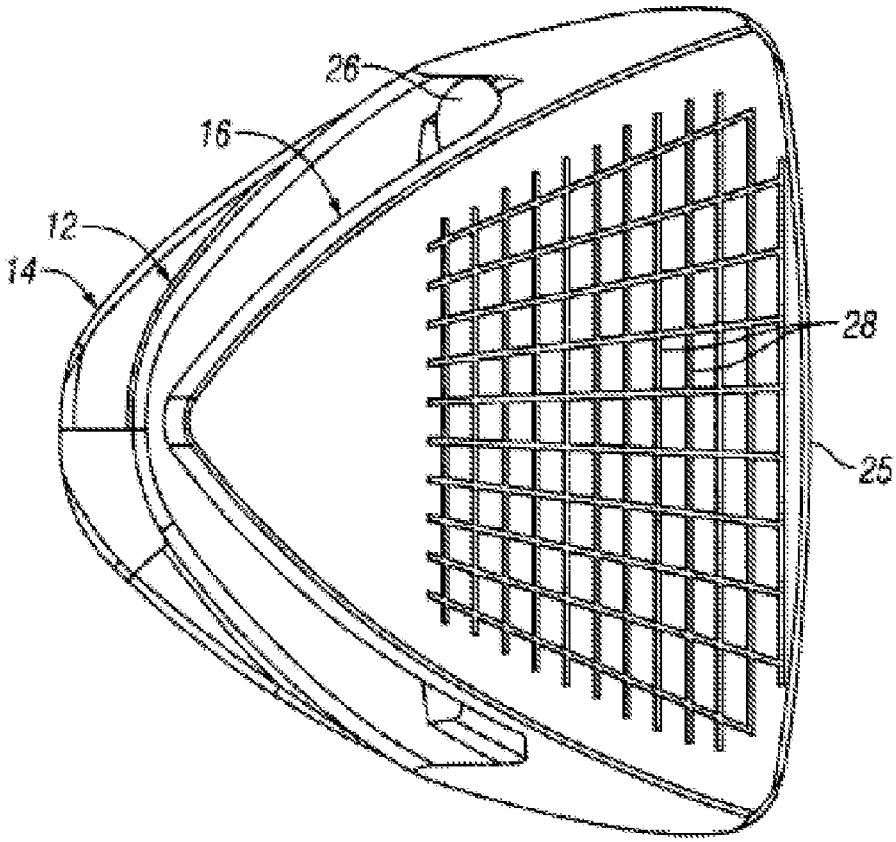
FIG. 2 is another schematic perspective view of the club head of the invention viewed from above.
Figure 3:
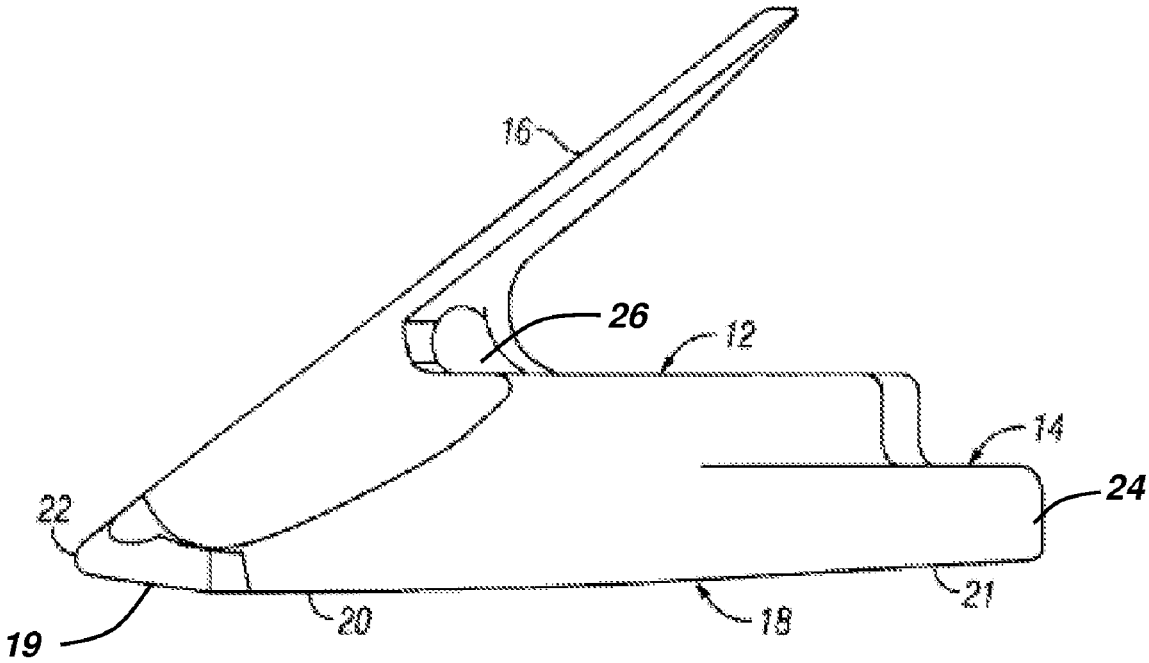
FIG. 3 is a schematic side view of the club head, taken from the left side.

As best shown in FIGS. 1-3, a golf club head 10 in accordance with the present invention comprises a body 12, a sole 14 and a generally planar face 16. The sole 14 has an undersurface 18 including a generally flat ground contact area 20. The undersurface 18 includes a forward portion 19 which is slightly curved, rising at an approximately 8° angle from the ground contact area 20 to the leading edge 22 where the forward portion 19 meets the face 16. The undersurface 18 also includes a trailing portion 21 which rises at a slight angle, approximately 2° or 3° between the ground contact area 20 and the trailing edge 24 of the sole 14.

Figure 4:
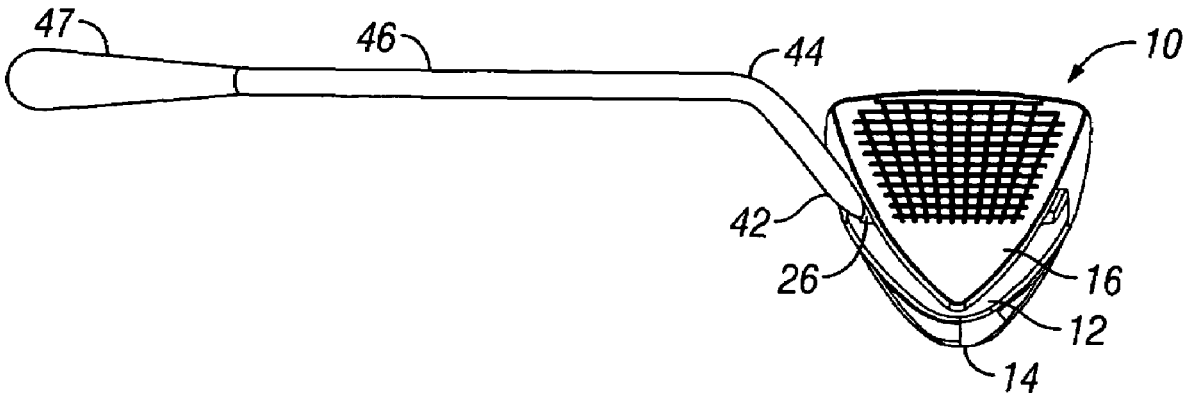
FIG. 4 is a schematic plan view of a golf club in accordance with the present invention.
Figure 5:
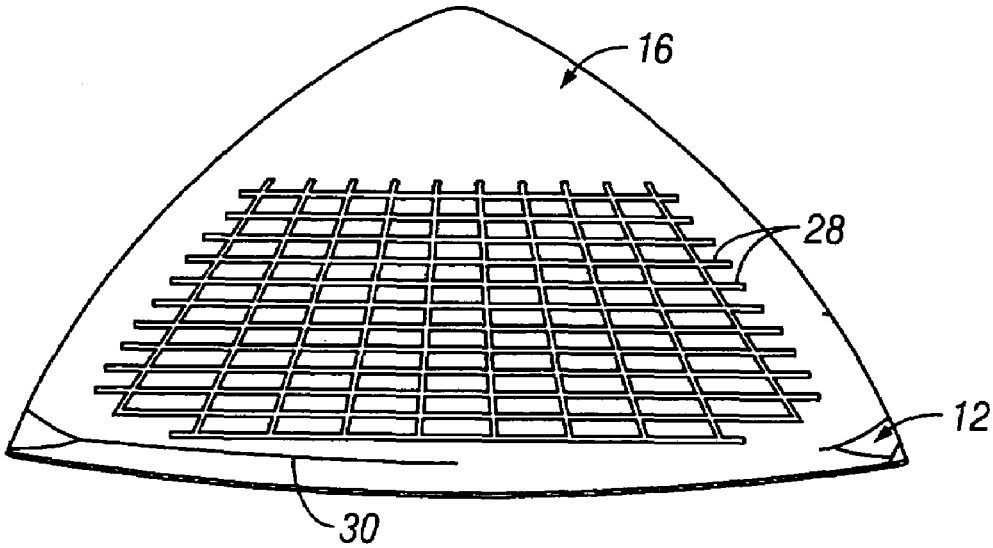
FIG. 5 is a schematic front elevation of the club head of FIG. 1.

The club head 10 is provided with a hosel 26 having an opening for receiving the lower end of the club shaft. The hosel 26 is located on club head 10 such that the hosel opening is located behind the plane of the face 16. The hosel 26 may be located on club head 10 substantially and directly behind the face 16. As shown in FIGS. 1, 2 and 4, for example, the hosel 26 is on the right-hand side of the head 10 which means this would be made for a right-handed golfer. For a left-handed golfer, the hosel 26 would be on the opposite side from the showing in these figures. Except for the hosel, the club head 10 is symmetrical about a mid-plane.

The face 16 is provided with a plurality of transverse grooves 27 and 28. These are cut into the face 16 with selected depths and widths. They help to impart spin to the ball. The face 16 also comprises a series of crescent-shaped ridges 30 at the toe 25 of the club head to serve as aiming lines to assist the golfer in directing the course of the ball.

As shown in FIG. 3, the face is set at an angle of 54° from the vertical. This is a preferred angle, although the angle may be anywhere in excess of 10° and up to approximately 70° if desired. This will give the desired loft to the ball when driving it from the fringe or the rough area surrounding the green. At the same time, the nose of the club head lifts sufficiently during a pendulum stroke in putting on the green to guide the ball accurately in the selected direction.

Figure 6:
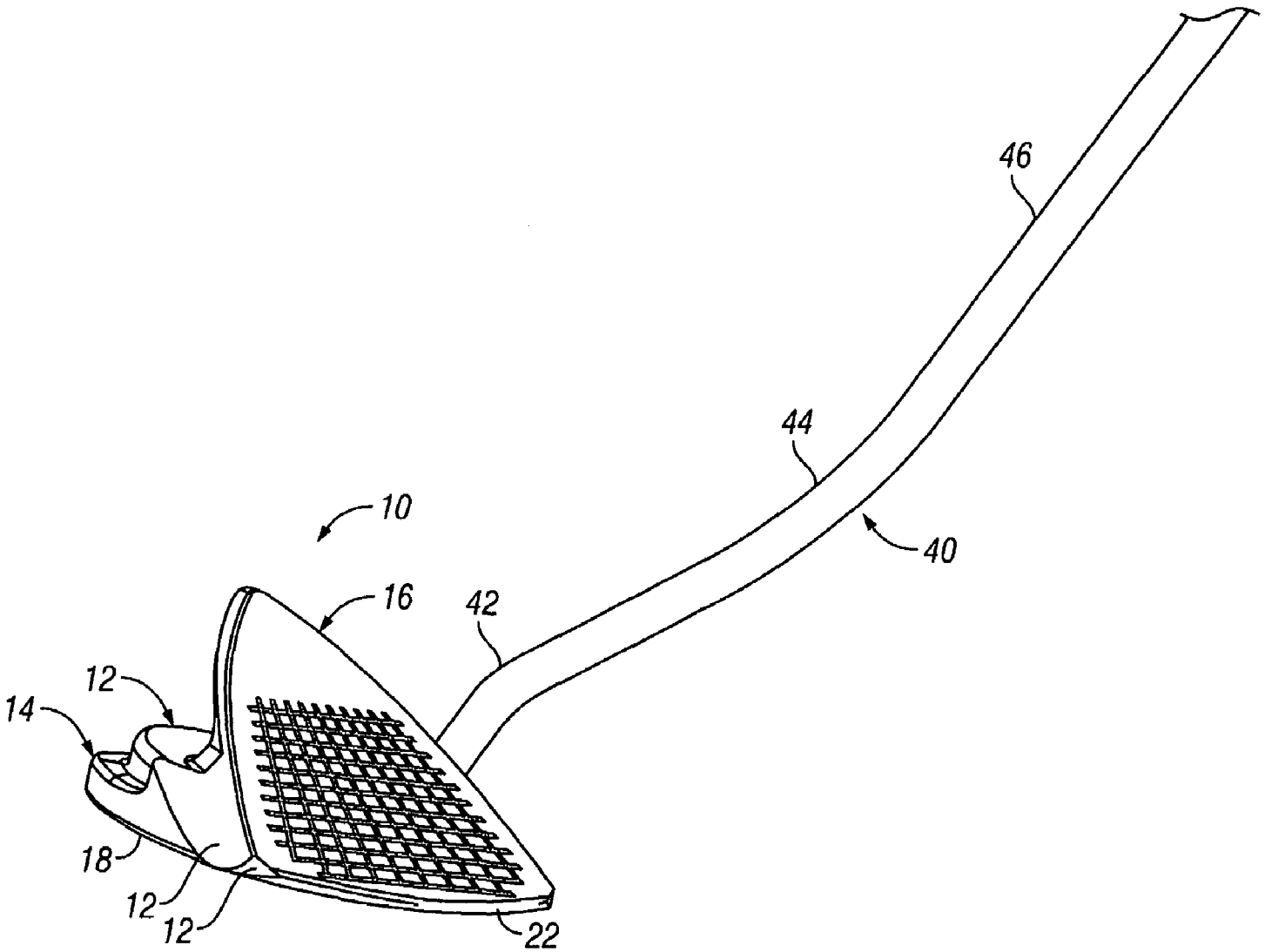
FIG. 6 is a schematic perspective view of the golf club of FIG. 4, taken from about 45° off the right front of the club.
Figure 7:
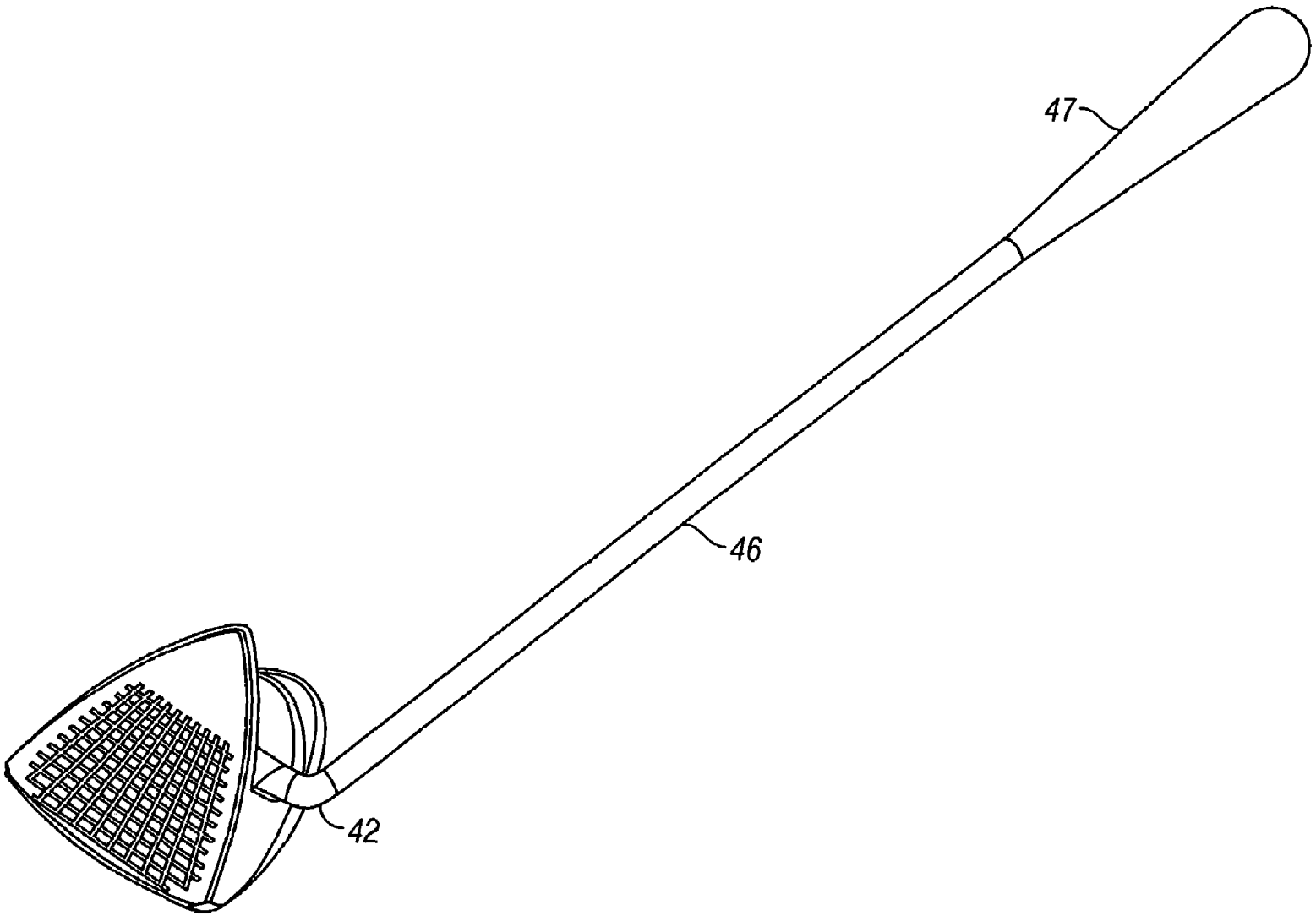
FIG. 7 is another schematic perspective view of the golf club in accordance with the present invention.

In the views of FIGS. 4, 6 and 7 which show the complete club with shaft and club head, viewed from different angles, the bends of the club shaft are apparent. These comprise a first curve 42 near the end of the shaft where it is inserted into the hosel 26 and a second curve 44 which is between the first curve 42 and the straight portion of the shaft 46. The club is completed with a grip 47. The second curve 44 is not visible in the view of FIG. 7 because that view is taken in the plane of the curve. From FIG. 7, it can be seen that the first curve 42 lies in a plane different from the plane of the second curve 44.

The benefit from having the club shaft shaped with these bends 42 and 44 as shown is that it positions the golfer's hands slightly ahead of the leading edge of the golf club when the club is resting in its natural position or when it is suspended from the golfer's hands, i.e., in a vertical position. It is important for the golfer to keep his hands at or ahead of the leading edge of the golf club when using the upper right pendulum stroke technique. This action and motion promote accuracy and solid contact with the golf ball during the stroke.

Although there have been described hereinabove various specific arrangements of a GOLF CLUB in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A golf club comprising:

a head including:

a generally planar face;

a sole; and a hosel having an opening to receive the lower end of a shaft; wherein the face is inclined at an angle of at least 10 degrees with respect to the plane of the sole, the head is symmetric about a vertical mid plane between and heel and a toe of said head, and the hosel opening is disposed on the head behind the plane of the face;

a shaft including a first curve and a second curve, the lower end of the shaft inserted into the hosel whereby the first and second curves are structured to enable a golfer's hands to remain slightly forward of a leading edge of the head when the golf club is held with the sole in a resting position.

2. The golf club of claim 1, wherein the hosel opening is disposed asymmetrically relative to the mid plane.

3. The golf club of claim 1, wherein the first curve lies in a first plane and the second curve lies in a second plane different from the first plane.

4. The golf club of claim 3, wherein the hosel opening is disposed on the head directly behind the face.

5. The golf club of claim 1, wherein the hosel opening is disposed on the head directly behind the face.

6. A golf club comprising:

a head comprising:

a sole extending along an undersurface of the head from a leading edge to a trailing edge;

a generally planar face inclined at an angle of at least 10 degrees with respect to a plane of the sole; and a hosel having an opening to receive the lower end of a shaft, the hosel opening disposed on the head behind the plane of the face, wherein the head is symmetric about a mid vertical plane between and heel and a toe of said head except for the hosel;

a shaft including a first curve and a second curve, the lower end of the shaft inserted into the hosel.

7. The golf club of claim 6, wherein the first curve lies in a first plane and the second curve lies in second plane different from the first plane.

8. The golf club of claim 7, wherein the hosel opening is disposed on the head directly behind the face.

9. The golf club of claim 6, wherein the face is inclined at an angle between 10 degrees and approximately 70 degrees to the plane of the sole.

10. The golf club of claim 9, wherein the golf club is a wedge and the face is inclined at an angle of approximately 54 degrees to the plane of the sole.

11. The golf club of claim 6, wherein the sole further comprises:

a central generally flat ground contact surface;

a forward portion rising at an approximately 8-degree angle from the ground contact surface to the leading edge; and a trailing portion rising at angle of approximately 2 degrees to 3 degrees from the ground contact surface to the trailing edge.

12. The golf club of claim 6, wherein the hosel opening is disposed on the head directly behind the face.

* * * * *